US010337165B2

(12) United States Patent
Akanda et al.

(10) Patent No.: US 10,337,165 B2
(45) Date of Patent: Jul. 2, 2019

(54) AUTOMATIC TILT CONTROL

(71) Applicant: Harnischfeger Technologies, Inc., Wilmington, DE (US)

(72) Inventors: Anab Akanda, Ann Arbor, MI (US); James Myron Maki, Kenosha, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 0 days.

(21) Appl. No.: 15/487,165

(22) Filed: Apr. 13, 2017

(65) Prior Publication Data

US 2017/0298592 A1 Oct. 19, 2017

Related U.S. Application Data

(60) Provisional application No. 62/323,093, filed on Apr. 15, 2016.

(51) Int. Cl.

| | |
|---|---|
| ***E02F 3/43*** | (2006.01) |
| ***E02F 9/26*** | (2006.01) |
| ***E02F 9/22*** | (2006.01) |
| ***E02F 3/40*** | (2006.01) |
| ***E21C 27/30*** | (2006.01) |
| ***E02F 3/30*** | (2006.01) |
| ***E21C 41/00*** | (2006.01) |
| *E02F 9/20* | (2006.01) |

(52) U.S. Cl.

CPC ..... *E02F 3/439* (2013.01); *E02F 3/308* (2013.01); *E02F 3/40* (2013.01); *E02F 9/2271* (2013.01); *E02F 9/265* (2013.01); *E21C 27/30* (2013.01); *E21C 41/00* (2013.01); *E02F 9/2016* (2013.01)

(58) Field of Classification Search

CPC ... E02F 3/439; E02F 3/308; E02F 3/40; E02F 9/2271; E02F 9/265; E02F 9/2016; E21C 27/30; E21C 41/00

USPC ..... 701/50

See application file for complete search history.

(56) References Cited

U.S. PATENT DOCUMENTS 5,701,691 A * 12/1997 Watanabe ..... E02F 3/435 172/4
5,735,065 A * 4/1998 Yamagata ..... E02F 3/437 37/348
5,768,810 A * 6/1998 Ahn ..... E02F 3/436 37/348
5,860,480 A * 1/1999 Jayaraman ..... E02F 3/845 172/2

(Continued)

FOREIGN PATENT DOCUMENTS

WO WO-2007080668 A1 * 7/2007 ..... B66F 9/065
WO WO-2015186179 A1 * 12/2015 ..... E02F 3/32

*Primary Examiner* — Tuan C To
(74) *Attorney, Agent, or Firm* — Michael Best & Friedrich LLP

(57) ABSTRACT

An industrial machine and methods for providing automatic tilt control for the same. One method includes determining a current tooth vector of a tooth included on a bucket of the industrial machine and a current path vector of the tooth and determining a current digging angle between the current tooth vector and the current path vector. The method also includes determining a delta angle based on the current digging angle and a target angle and automatically adjusting a tilt of the bucket based on the delta angle.

20 Claims, 16 Drawing Sheets

(56) References Cited

U.S. PATENT DOCUMENTS

| | | | | | |
|---|---|---|---|---|---|
| 5,933,346 | A * | 8/1999 | Brabec | E02F 9/2025 | 340/684 |
| 5,974,352 | A * | 10/1999 | Shull | E02F 3/432 | 172/4.5 |
| 6,169,948 | B1 * | 1/2001 | Fujishima | E02F 3/435 | 172/4.5 |
| 6,205,687 | B1 * | 3/2001 | Rocke | E02F 3/431 | 37/348 |
| 6,385,519 | B2 * | 5/2002 | Rocke | E02F 3/434 | 172/415 |
| 7,658,234 | B2 * | 2/2010 | Brandt | A01B 63/112 | 172/7 |
| 9,670,641 | B2 * | 6/2017 | Paull | E02F 9/2228 | |
| 10,006,189 | B2 * | 6/2018 | Kitajima | E02F 3/32 | |
| 2008/0086920 | A1 * | 4/2008 | Lim | E02F 3/3677 | 37/406 |
| 2009/0159302 | A1 * | 6/2009 | Koch | E02F 3/437 | 172/2 |
| 2010/0257759 | A1 * | 10/2010 | Ko | E02F 9/2825 | 37/456 |
| 2016/0281331 | A1 * | 9/2016 | Ikegami | E02F 9/2228 | |
| 2017/0107688 | A1 * | 4/2017 | Fujii | E02F 3/3677 | |
| 2017/0198456 | A1 * | 7/2017 | Worth | E02F 3/40 | |
| 2017/0247860 | A1 * | 8/2017 | Lehtinen | E02F 3/283 | |

* cited by examiner

AUTOMATIC TILT CONTROL

RELATED APPLICATIONS

This application claims priority to U.S. Provisional Application No. 62/323,093 filed Apr. 15, 2016, the entire content of which is incorporated by reference herein.

BACKGROUND

Embodiments described herein relate to mining shovels and, in particular, to methods and systems for providing automatic tilt control for a mining shovel.

SUMMARY

During digging, an operator of mining machinery, such as a mining shovel, coordinates the hoist, crowd, and tilt motion such that the corresponding bucket orientation provides a maximum payload accumulation as quickly as possible for efficient operation. This can be a very difficult task for certain digging conditions, such as a rope-shovel dig path and a flat floor dig path. Additionally, improper engagement of the tilt function may result in a loss of productivity, machine damage, or both.

Therefore, embodiments described herein provide methods and systems for performing automatic tilt control, such as tilt control that assists an operator during particular digging conditions or work cycles. In particular, some embodiments provide methods and systems for actuating tilt motion in response to hoist and crowd commands such that the digging angle (θ) between a current (instantaneous) tooth vector and a current (instantaneous) dig path trajectory is limited by a predefined and configurable value and the physical operating envelop of the mining shovel. For example, a controller associated with the mining shovel may receive inputs including machine orientation (X and Y positions for tooth, lip, maximum tooth, minimum tooth, maximum up, and minimum lip) and tilt cylinder rod and cap side pressures. Based on the inputs, the controller computes the current digging angle and the limits of this angle based on the physical operating envelop of the shovel. The controller may then adjust the tilt of the shovel to bring the current digging angle closer to a target digging angle. In some embodiments, the controller implements a feedback control loop, such as, for example, a PID (proportional-integral-derivative) controller, a fuzzy neural controller, a ratio controller, or the like, to bring the current digging angle close to the desired angle. The gains of theses feedback mechanisms may be constant or may vary linearly or non-linearly. In some embodiments, the controller may apply one or more overrides based on motion limits, overrunning loading (cylinder cavitation), operator intervention, or a combination thereof. In some embodiments, the controller is manually activated by the operator and may be selectively disabled by the operator.

For example, some embodiments described herein provide a method of providing tilt control for a mining machine including a bucket. The method includes determining, with an electronic processor, a current tooth vector of a tooth included on the bucket and a current path vector of the tooth and determining, with the electronic processor, a current digging angle between the current tooth vector and the current path vector. The method also includes determining, with the electronic processor, a delta angle based on the current digging angle and a target angle, and automatically adjusting a tilt of the bucket based on the delta angle.

Another embodiment provides an industrial machine including a bucket having a tooth and a controller. The controller is configured to determine a current tooth vector of the tooth and a current path vector of the tooth. The controller is also configured to determine a maximum angle of the tooth and a minimum angle of the tooth, access a target angle, and adjust the target angle in response to the target angle being greater than the maximum angle of the tooth or less than the minimum angle of the tooth. In addition, the controller is configured to determine a current digging angle between the current tooth vector and the current path vector, determine a delta angle based on the current digging angle and the target angle, and automatically adjust a tilt of the bucket based on the delta angle via a pivot actuator.

Yet another embodiment includes non-transitory, computer-readable medium storing instructions that, when executed by an electronic processor, perform a set of functions. The set of functions includes determining a current tooth vector of a tooth included on a bucket of an industrial machine and a current path vector of the tooth. The set of functions also includes determining a maximum angle of the tooth and a minimum angle of the tooth, accessing a target angle, and adjusting the target angle in response to the target angle being greater than the maximum angle of the tooth or less than the minimum angle of the tooth. In addition the set of functions includes determining a current digging angle between the current tooth vector and the current path vector, determining a delta angle based on the current digging angle and the target angle, and automatically adjusting a tilt of the bucket using a feedback control loop based on the delta angle via a pivot actuator.

Other aspects will become apparent by consideration of the detailed description and accompanying drawings.

DETAILED DESCRIPTION

Before any embodiments are explained in detail, it is to be understood that the embodiments described herein are provided as examples and the details of construction and the arrangement of the components described herein or illustrated in the accompanying drawings should not be considered limiting. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and may include electrical connections or couplings, whether direct or indirect. Also, electronic communications and notifications may be performed using any known means including direct connections, wireless connections, and the like.

It should be noted that a plurality of hardware and software based devices, as well as a plurality of different structural components may be utilized to implement the embodiments described herein or portions thereof. In addition, it should be understood that embodiments described herein may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects described herein may be implemented in software (stored on non-transitory computer-readable medium) executable by one or more processors. As such, it should be noted that a plurality of hardware and software based devices, as well as a plurality of different structural components may be used to implement the embodiments described herein. For example, "controller" and "control unit" described in the specification may include one or more processors, one or more memory modules including non-transitory computer-readable medium, one or more input/output interfaces, and various connections (for example, a system bus) connecting the components.

Figure 1:
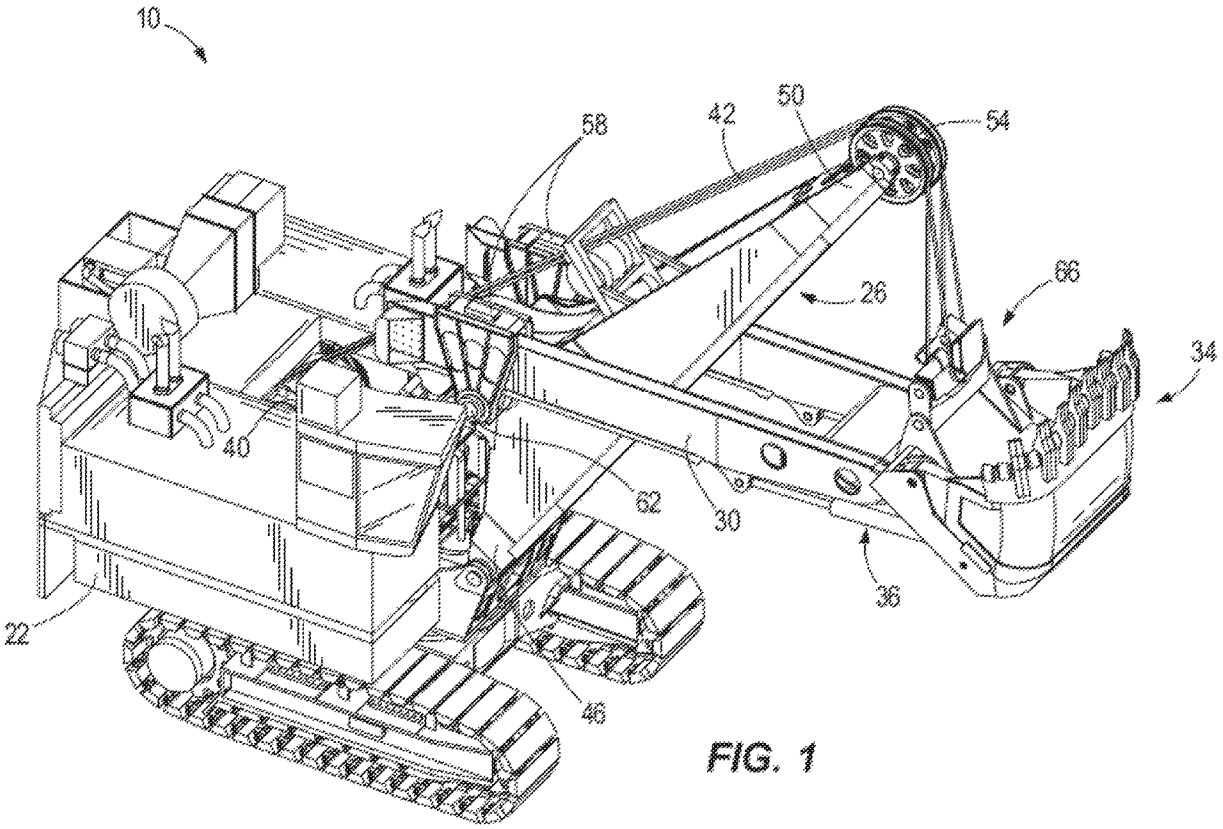
FIG. 1 is a perspective view of a mining shovel.

FIG. 1 illustrates a mining shovel 10. It should be understood that the shovel 10 is provided as an example and embodiments described herein may be used with shovels or other mining machinery that differ from the shovel 10 illustrated in FIG. 1.

Figure 2:
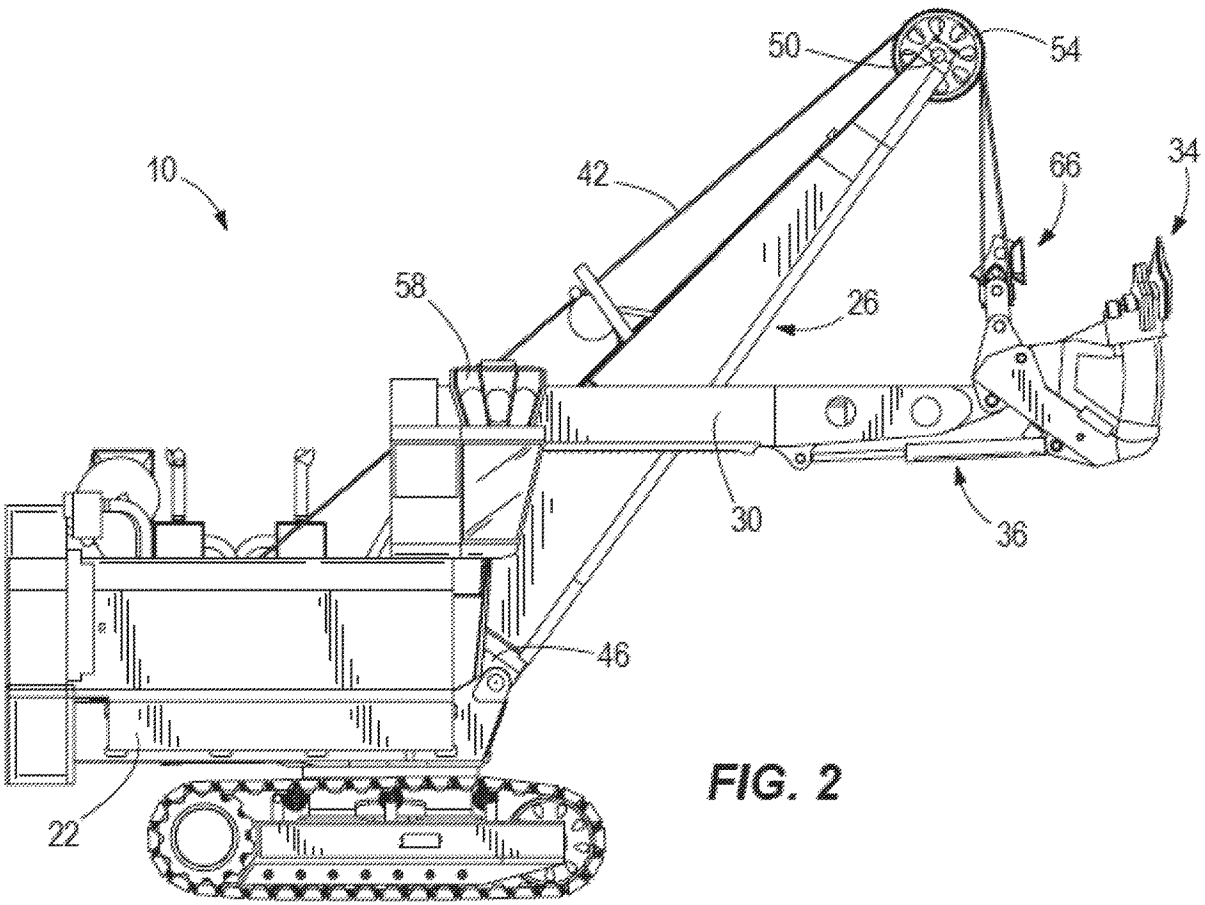
FIG. 2 is a side view of the mining shovel of FIG. 1.
Figure 6:
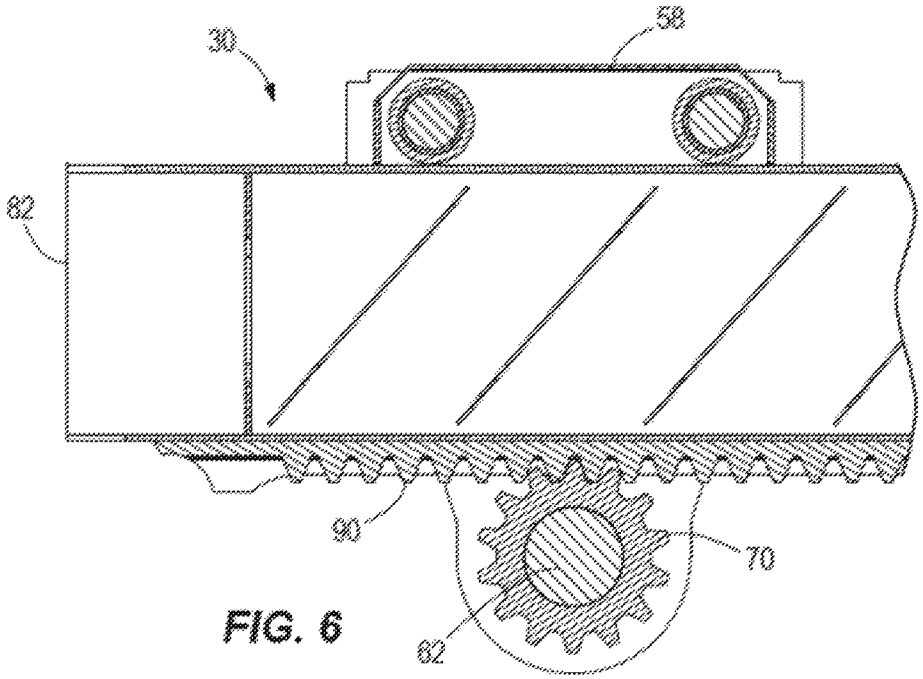
FIG. 6 is an enlarged cross-sectional view of the handle shown in FIG. 5.

As illustrated in FIGS. 1 and 2, the mining shovel 10 rests on a support surface, or floor, and includes a base 22, a boom 26, a first member or handle 30, a bucket 34, and a pivot actuator 36. The base 22 includes a hoist drum 40 (FIG. 1) for reeling in and paying out a hoist rope 42. The boom 26 includes a first end 46 coupled to the base 22, a second end 50 opposite the first end 46, a boom sheave 54, a saddle block 58, and a shipper shaft 62 (FIG. 1). The boom sheave 54 is coupled to the second end 50 of the boom 26 and guides the hoist rope 42 over the second end 50. The hoist rope 42 is coupled to the bucket 34 by a bail 66. The bucket 34 is raised or lowered as the hoist rope 42 is reeled in or paid out, respectively, by the hoist drum 40. The saddle block 58 is rotatably coupled to the boom 26 by the shipper shaft 62, which is positioned between the first end 46 and the second end 50 of the boom 26 and extends through the boom 26. The shipper shaft 62 includes a spline pinion 70 (FIG. 6). The handle 30 is moveably coupled to the boom 26 by the saddle block 58.

Figure 3:
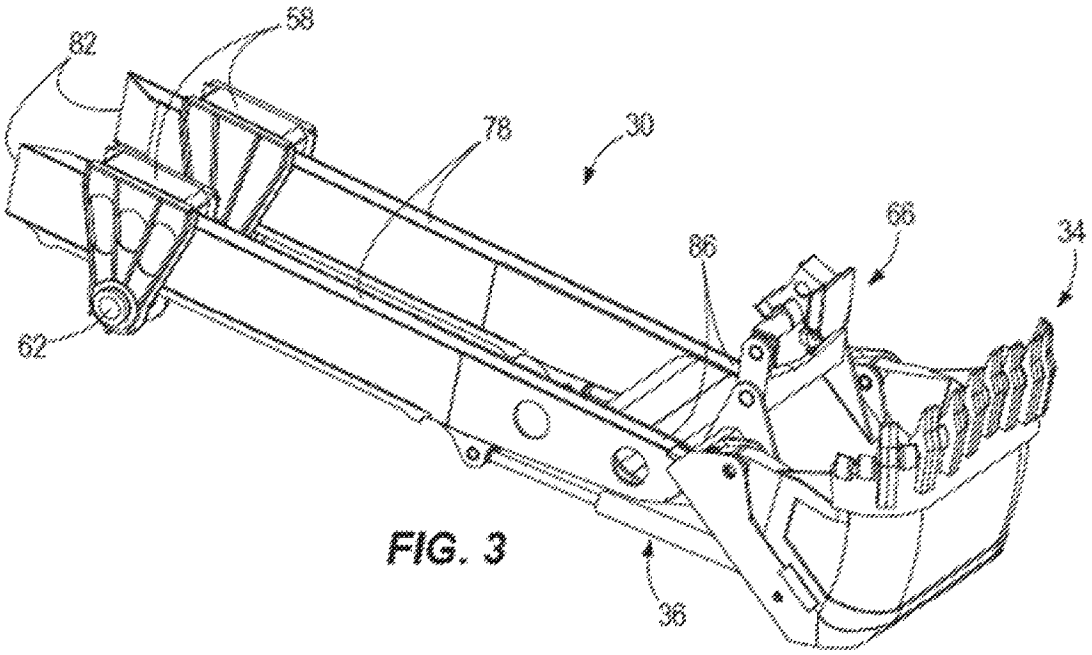
FIG. 3 is a perspective view of a handle and bucket included in the mining shovel of FIG. 1.
Figure 4:
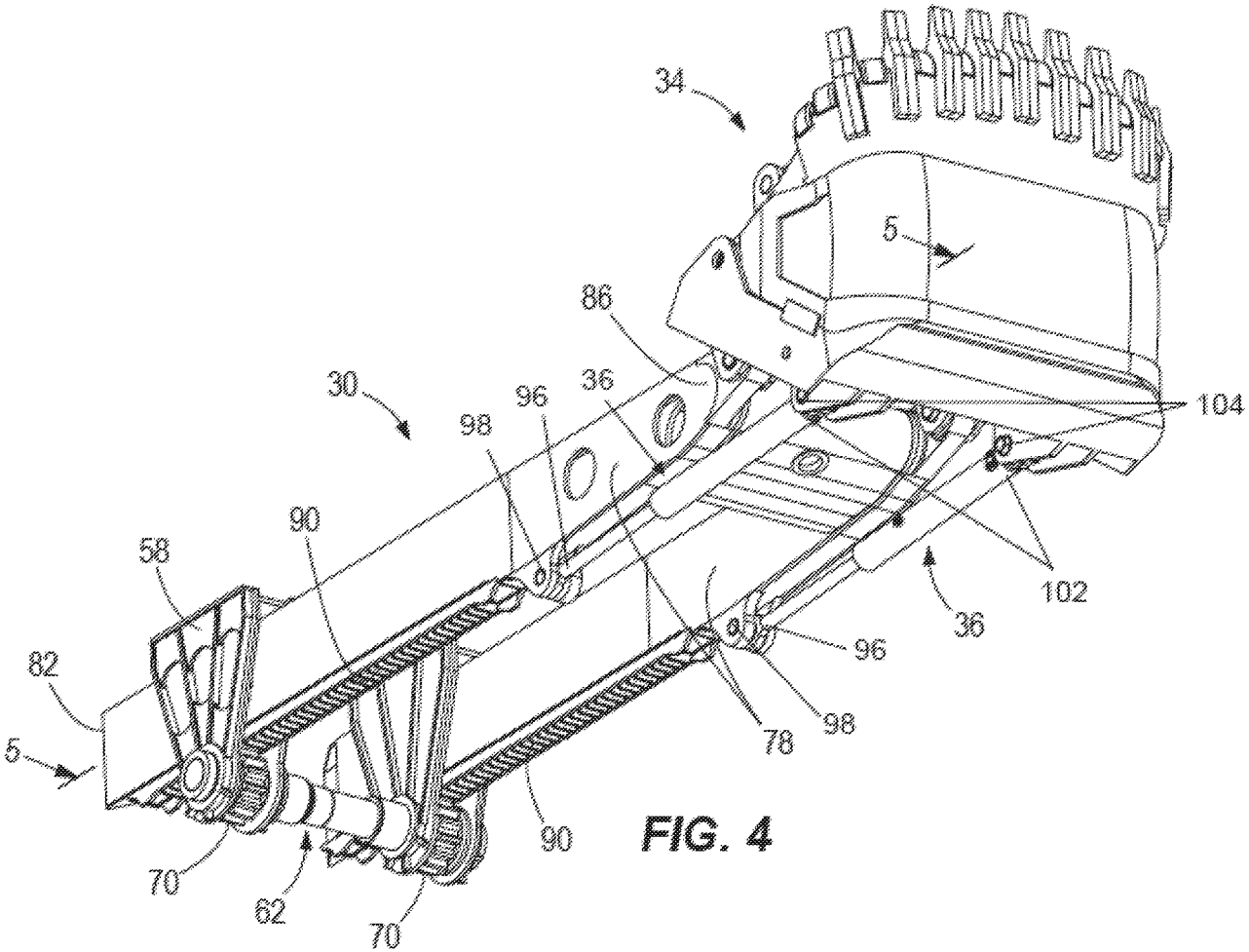
FIG. 4 is a lower perspective view of the handle and bucket of FIG. 3.
Figure 5:
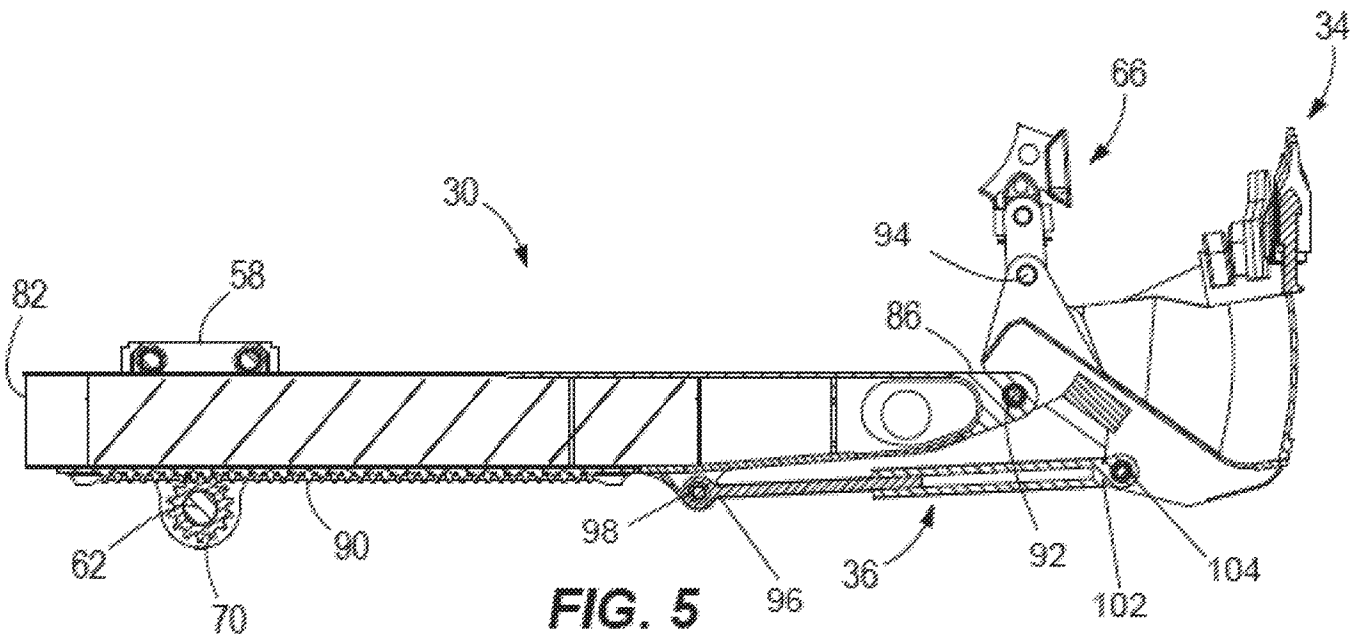
FIG. 5 is a cross-sectional view of the handle and bucket of FIG. 4, taken along line 5-5.

As illustrated in FIGS. 3 and 4, the handle 30 includes a pair of arms 78 defining a first end 82, a second end 86, and a rack 90 (FIG. 4) for engaging the spline pinion 70 (FIG. 4). The first end 82 of the handle 30 is moveably received in the saddle block 58, and the handle 30 passes through the saddle block 58 such that the handle 30 is configured for rotational and translational movement relative to the boom 26 (FIG. 1). Stated another way, the handle 30 is linearly extendable relative to the saddle block 58 and is rotatable about the shipper shaft 62. In the illustrated embodiment, the handle 30 is substantially straight. In other embodiments, the handle 30 may include a curved portion. As shown in FIGS. 5 and 6, the rack 90 engages the spline pinion 70, and rotation of the shipper shaft 62 facilitates translational movement of the handle 30 via a rack and pinion mechanism.

As illustrated in FIG. 5, the bucket 34 is pivotably coupled to the second end 86 of the handle 30 at a wrist joint 92. The bail 66 is coupled to the hoist rope 42 (FIG. 1) passing over the boom sheave 54 (FIG. 1) and is pivotably coupled to the bucket 34 about a first joint (bail joint 94). In the illustrated embodiment, the wrist joint 92 and the bail joint 94 are pin couplings. In other embodiments, the bail 66 is pivotably coupled to the handle 30. In other embodiments, the bucket 34 may be coupled to another type of hoist actuator at the bail joint 94.

The pivot actuator 36 controls the pitch or tilt of the bucket 34 by rotating the bucket 34 about the wrist joint 92. As illustrated in FIGS. 4 and 5, the pivot actuator 36 includes a first end 96 coupled to the handle 30 at a second joint 98 and a second end 102 coupled to the bucket 34 at a third joint 104. In the illustrated embodiment, the pivot actuator 36 includes a pair of hydraulic cylinders directly coupled between a lower portion of the handle 30 and a lower portion of the bucket 34. In other embodiments, a different type of actuator may be used. In still other embodiments, the actuator is coupled between an upper portion of the handle 30, an upper portion of the bucket 34, or both. In still other embodiments, the pivot actuator 36 is coupled to the bucket via an intermediate linkage.

Figure 7:
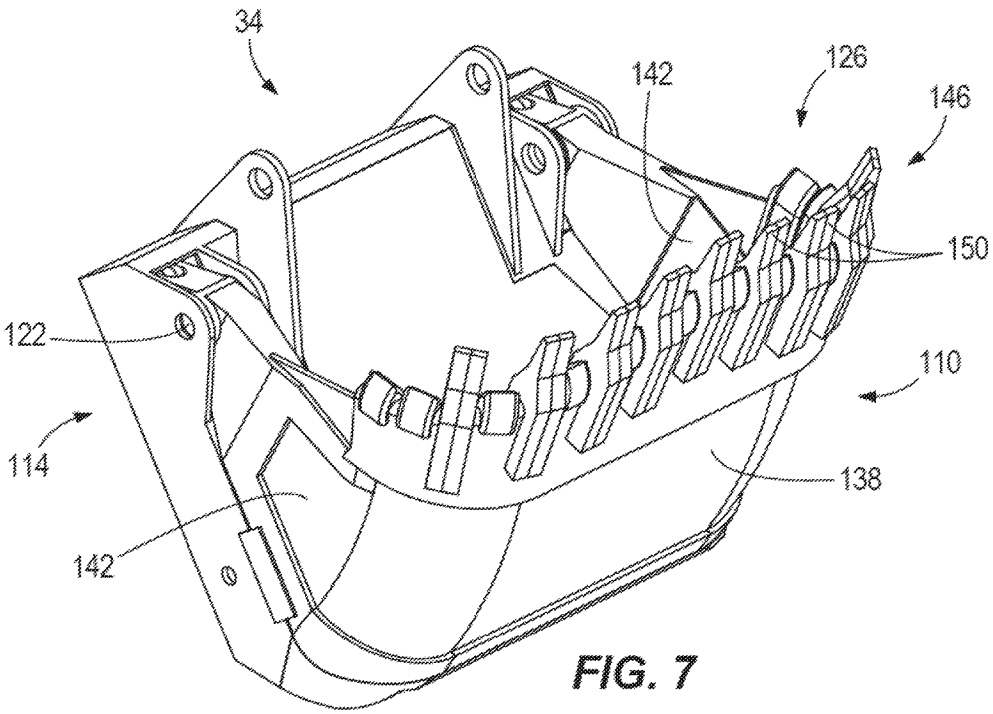
FIG. 7 is a perspective view of a bucket.
Figure 8:
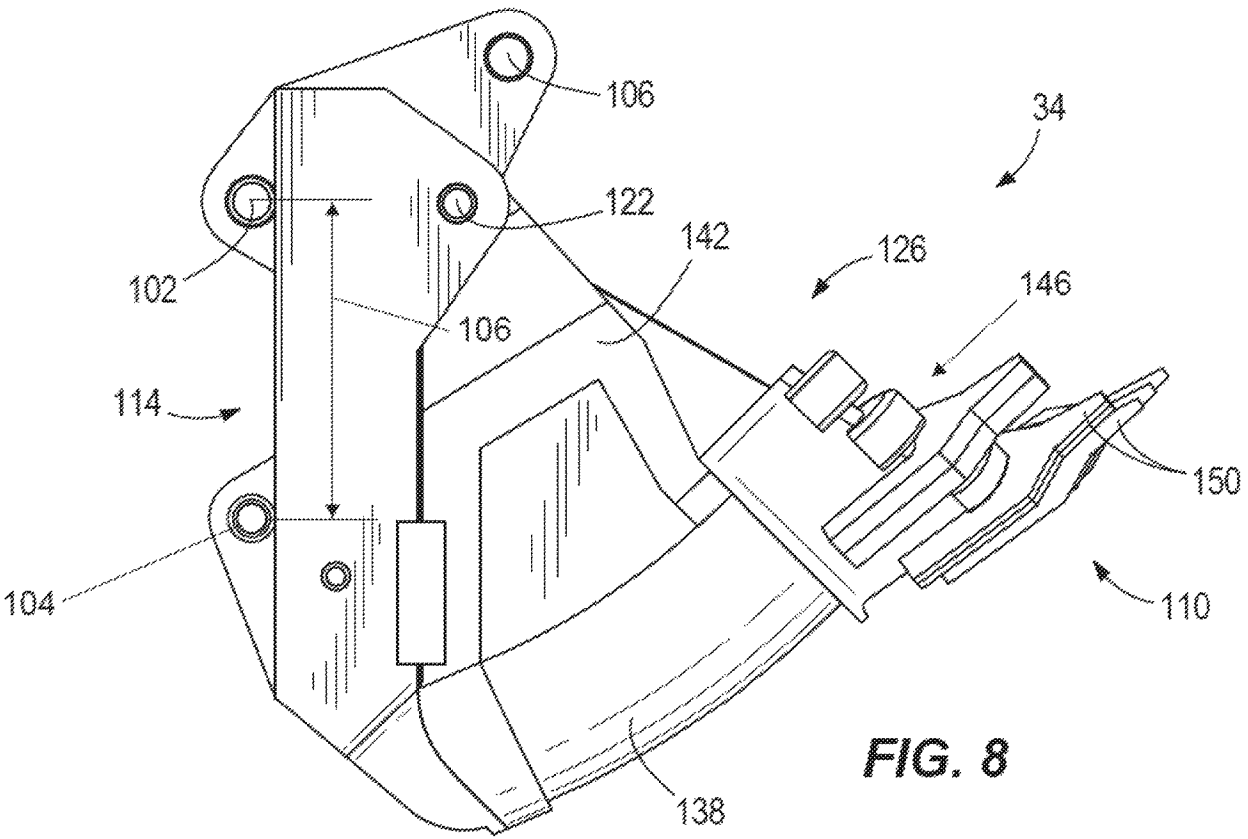
FIG. 8 is a side view of the bucket of FIG. 7.

As illustrated in FIGS. 7 and 8, the bucket 34 may be a clamshell-type bucket including a main body 110 and an end wall or rear wall 114. The main body 110 is pivotably coupled to the rear wall 114 about a bucket joint 122. The main body 110 defines a material receiving opening 126 on one end and a material discharging opening on an opposite end. The main body 110 includes a lower wall 138 and side walls 142 extending between the material receiving opening 126 and the material discharging opening, and a digging edge or lip 146 proximate the material receiving opening. In the illustrated embodiment, the side walls 142 are coupled to the rear wall 114 via the bucket joint 122.

As illustrated in FIG. 7, the lip 146 includes a plurality of spaced-apart teeth 150. In other embodiments, the lip 146 includes a single tooth extending along the edge of the lip 146 rather than the plurality of spaced-apart teeth 150. The lip 146 forms a curved, continuous transition or profile between the lower wall 138 and the side walls 142 rather than a square corner. The curved profile of the lip 146 is positioned to engage the material to be dug and reduces torsion loads on the side walls 142. That is, the corner between each side wall 142 and the lower wall 138 is round and at least one tooth included in the plurality of spaced-apart teeth 150 is positioned along the rounded corner proximate each side wall 142. In one embodiment, the radius of the round is greater than or equal to approximately 5% of a width of the bucket 34 as measured from one side wall 142 to the other side wall 142. The large radius profile facilitates movement of the bucket 34 through the material to be dug, which increases digging efficiency.

Figure 9:
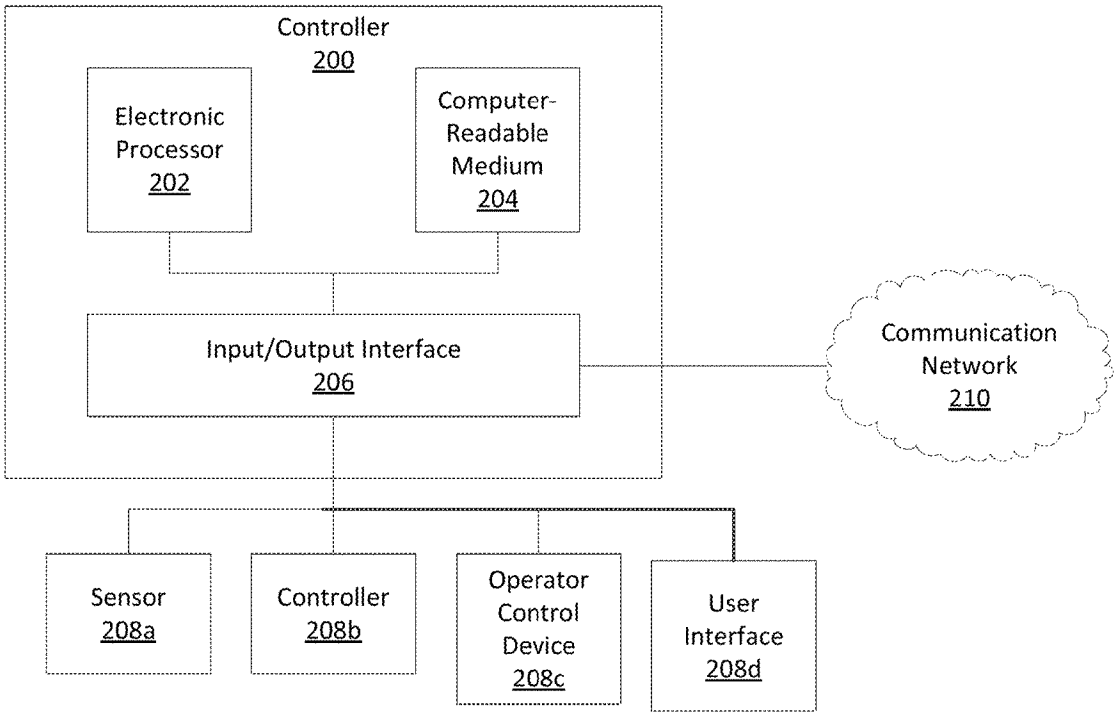
FIG. 9 schematically illustrates a controller associated with the mining shovel of FIG. 1.

Although not illustrated in FIG. 1 or 2, the shovel 10 also includes one or more controllers for controlling the components of the shovel 10. For example, FIG. 9 schematically illustrates a controller 200 included in the shovel 10 according to one embodiment. As illustrated in FIG. 9, the controller 200 includes an electronic processor 202 (for example, a microprocessor, application specific integrated circuit (ASIC), or other electronic device), an input/output interface 206, and a computer-readable medium 204. The electronic processor 202, the input/output interface 206, and the computer-readable medium 204 are connected by and communicate through one or more communication lines or busses. It should be understood that the controller 200 may include fewer or additional components than those illustrated in FIG. 9 and may include components in configurations other than the configuration illustrated in FIG. 9. Also, the controller 200 may be configured to perform additional functionality than the functionality described herein. Additionally, the functionality of the controller 200 may be distributed among more than one controller. Accordingly, functionality described herein as being performed by the electronic processor 202 may be performed by a plurality of electronic processors included in the controller 200, a separate device, or a combination thereof. Furthermore, in some embodiments, the controller 200 may be located remote from the shovel 10.

The computer-readable medium 204 includes non-transitory memory (for example, read-only memory, random-access memory, or combinations thereof) storing program instructions (software) and data. The electronic processor 202 is configured to retrieve instructions and data from the computer-readable medium 204 and execute, among other things, the instructions to perform the methods described herein. The input/output interface 206 transmits data from the controller 200 to external systems, networks, devices, or a combination thereof and receives data from external systems, networks, devices, or a combination thereof. The input/output interface 206 may also store data received from external sources to the computer-readable medium 204, provide received data to the electronic processor 202, or both. In some embodiments, as illustrated in FIG. 9, the input/output interface 206 includes a wireless transmitter that communicates with a communication network 210.

As illustrated in FIG. 9, the controller 200 may communicate with one or more sensors 208*a* (for example, through the input/output interface 206). The sensors 208*a* may be included in the controller 200 or may be external to the controller 200. In some embodiments, the controller 200 communicates with the sensors 208*a* over a wired or wireless connection directly or through one or more intermediary devices, such as another controller, an information bus, the communication network 210, and the like. In some embodiments, the sensors 208*a* include one or more pressure sensors that detect a pressure of the pivot actuator 36 (for example, a pressure on the rod side, cap side, or both of each hydraulic cylinder included in the pivot actuator 36). In some embodiments, the sensors 208*a* also include other devices for detecting a hoist position, a crowd position, or other positions or movements of the bucket 34 or other components of the shovel 10 (for example, using encoders, position sensors, motion sensors, and the like).

Similarly, the controller 200 may communicate with one or more controllers 208*b* associated with the shovel 10 (mounted on the shovel 10 or remote from the shovel 10). In some embodiments, a controller 208*b* may communicate with the sensors 208*a* and may act as an intermediary device between the controller 200 and the sensors 208*a*. The controllers 208*b* may also operate components of the shovel 10. For example, as described below in more detail, the controller 200 may be configured to determine a tilt position or adjustment, and the controller 200 may control the pivot actuator 36 based on the tilt position or may output the tilt position to a separate controller 208*b* configured to control the pivot actuator 36.

In some embodiments, the controller 200 also receives input from one or more operator control devices 208*c* (for example, a joystick, a lever, a button, a foot pedal, another actuator operated by the operator to control the operation of the shovel 10, or a combination thereof). For example, an operator may use the operator control devices 208*c* to operate the shovel 10, including commanding movement of the bucket 34 by controlling hoist (through the hoist rope 42), crowd (through the handle 30), and tilt (through the pivot actuator 36). In some embodiments, the controller 200 also communicates with one or more user interfaces 208*d* (for example, through the input/output interface 206), such as a display device or a touchscreen. The user interfaces 208*d* may display feedback to an operator regarding, for example, tilt control. Also, in some embodiments, the user interfaces 208*d* allow an operator to input data, such as operational data or instructions for the shovel 10, tilt control configuration data (for example, within a system configuration parameter file), or both.

As described above, the bucket 34 is connected to three components: 1) the second end 86 of the handle 30 at the wrist joint 92 (controlling crowd); 2) the pivot actuator 36 at the third joint 104 (controlling tilt); and 3) the hoist rope 42 at the bail joint 94 (controlling hoist). The relative positions of the wrist joint 92, the bail joint 94, the second joint 98, and the third joint 104 may be altered to optimize the behavior of the bucket 34 during a dig cycle. Accordingly, as noted above, an operator of the shovel 10 routinely coordinates the hoist, crowd, and tilt motion through operation of one or more operator control devices 208*c* to provide maximum payload accumulation as quickly as possible for efficient operation. However, this can be a difficult task for certain digging conditions. Additionally, improper engagement of the tilt function may result in a loss of productivity, machine damage, or both.

Figure 10:
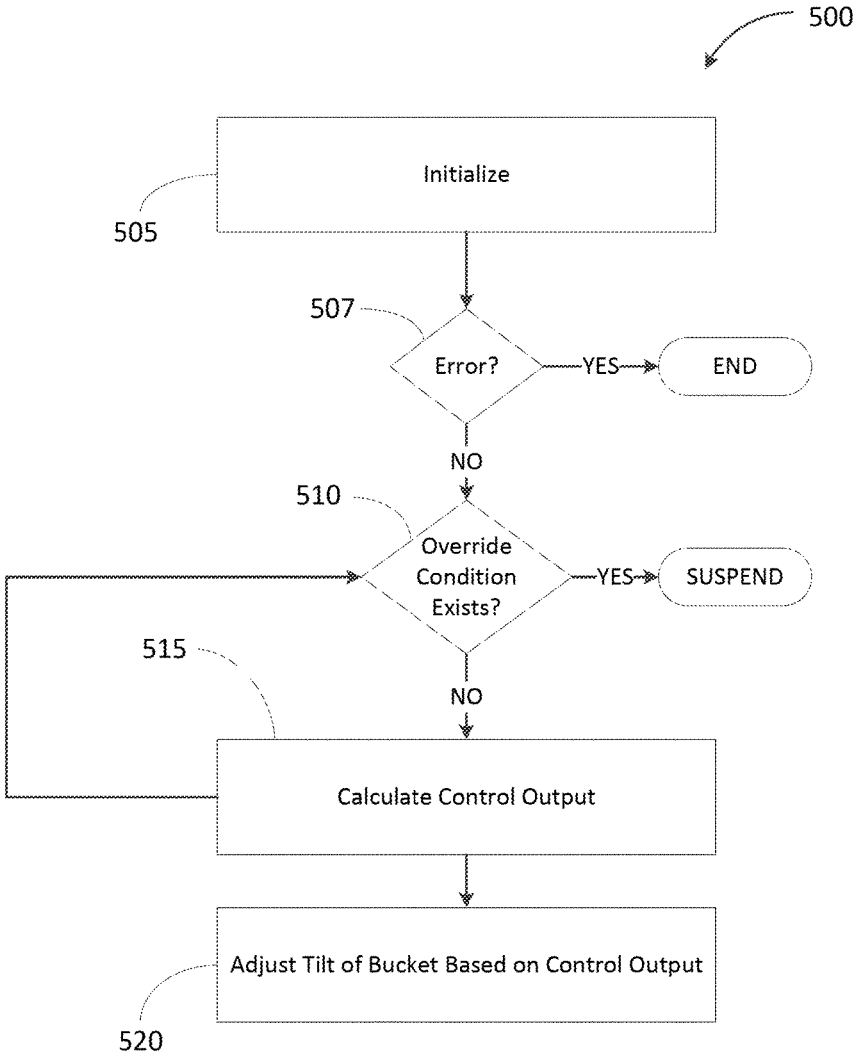
FIG. 10 is a flow chart illustrating a method of controlling tilt of a bucket performed by the controller of FIG. 9 according to one embodiment.

Accordingly, the controller 200 may be configured to automatically control tilt of the bucket 34 (through the pivot actuator 36). In some embodiments, the controller 200 may be configured to control tilt of the bucket 34 in response to the hoist and crowd commands. FIG. 10 illustrates a method 500 performed by the controller 200 (the electronic processor 202 executing instructions) for automatically controlling tilt of the bucket 34.

As illustrated in FIG. 10, the method 500 includes initializing the controller 200 (at block 505). Initializing the controller 200 may include reading, with the controller 200, a system configuration parameter file. The system configuration parameter file may be stored in the computer-readable medium 204 or an external memory accessible by the controller 200. The system configuration parameter file includes parameters, limits, and targets for the shovel 10.

For example, the system configuration parameter file may include pressure limits, gain values, one or more digging angles, and other variables (for example, limits and parameters) of the shovel 10.

In particular, in some embodiments, the system configuration parameter file includes a target angle that represents a desired tilt angle for the bucket 34, which, as described in more detail below, the controller 200 may maintain as part of performing automatic tilt control for the shovel 10. The system configuration parameter file may also include a minimum pressure that represents a lowest pressure that hydraulic cylinders included in the pivot actuator 36 may experience with limited risk of cavitation. In some embodiments, the system configuration parameter file also includes a maximum path angle and a minimum path angle. The maximum path angle may represent a maximum limit of a digging zone of the shovel 10, and the minimum path angle may represent a minimum limit of a digging zone of the shovel 10. The system configuration parameter file may also include a maximum digging angle. Also, in some embodiments, the system configuration parameter file includes gain values (for example, a proportional gain value, integral gain value, and derivative gain value) for a proportional-integral-derivative (PID) controller.

In addition, the system configuration parameter file may include a minimum movement value, which represents a minimum amount of movement in path magnitude indicating that an operator is commanding movement of the bucket 34. For example, in some embodiments, the controller 200 may perform the method 500 while an operator is commanding movement of the bucket 34. Accordingly, the controller 200 may use the minimum movement value to determine whether an operator is commanding movement of the bucket. Also, in some embodiments, the system configuration parameter file includes a minimum tilt reference representing a tilt reference that allows an operator to manually control tilt. In some embodiments, the data included in the system configuration parameter file (or a portion thereof) is editable by a user (the operator) to configure automatic tilt control performed by the controller 200.

In addition to or as alternative to reading the system configuration parameter file, the controller 200 may be initialized by obtaining one or more system parameters via one or more sensors 208*a*. For example, the controller 200 may obtain data from the sensors 208*a* representing a pressure on a rod side, a cap side, or both for each hydraulic cylinder included in the pivot actuator 36. The data from the sensors 208*a* may also include operator controls (for example, hoist and crowd controls).

As part of an initialization, the controller 200 may also obtain machine orientation data from a kinetic model representing the physical operating envelop of the shovel 10. The machine orientation may include two-dimensional (for example, X and Y) positions for one or more of the plurality of spaced-apart teeth 150, two-dimensional (for example, X and Y) positions of the lip 146, a maximum position of the teeth 150, a minimum position of the teeth 150, a maximum position of the lip 146, and a minimum position of the lip 146.

It should be understood that, in some embodiments, the controller 200 obtains the above data both as part of the initialization and also at other times during the method 500. For example, at each new cycle of the method 500, the controller 200 may obtain updated data as described above (for example, from the sensors 208*a*, the system configuration parameter file, and the like). Similarly, in some embodiments, the controller 200 may obtain updated data during a cycle of the method 500, such when the controller 200 checks for an override condition, calculates a control output, performs an adjustment, or any combination thereof. Accordingly, it should be understood that as used in the present application the term "input data" may include pressure data associated with the pivot actuator 36, operator controls, machine orientation data, data read from a system configuration parameter file, or a combination thereof received at any point during the method 500, including during initialization and thereafter. As illustrated in FIG. 10, in some embodiments, when an error occurs during initialization, such as when the system configuration parameter file includes corrupt data or cannot be read or data from one or more sensors 208*a* is unavailable, the method 500 ends.

Returning to FIG. 10, after initialization, the method 500 includes determining, with the controller 200, whether an override condition exists (at block 510). The controller 200 may determine whether an override condition exists based on input data, which as noted above includes data read from the system configuration parameter file, pressure data associated with the pivot actuator 36, operator controls, machine orientation data, and the like. As described in more detail below, when an override condition exists, the controller 200 may initiate suspend the method 500. As used in the present application, suspending the method 500 may include ending the method 500, pausing the method 500, restarting the method 500 or a portion thereof (a check for override conditions), or a combination thereof. In some embodiments, the controller 200 generates a notification for an operator of the shovel 10 that alerts the operator of any suspension of automatic tilt control.

Figure 11:
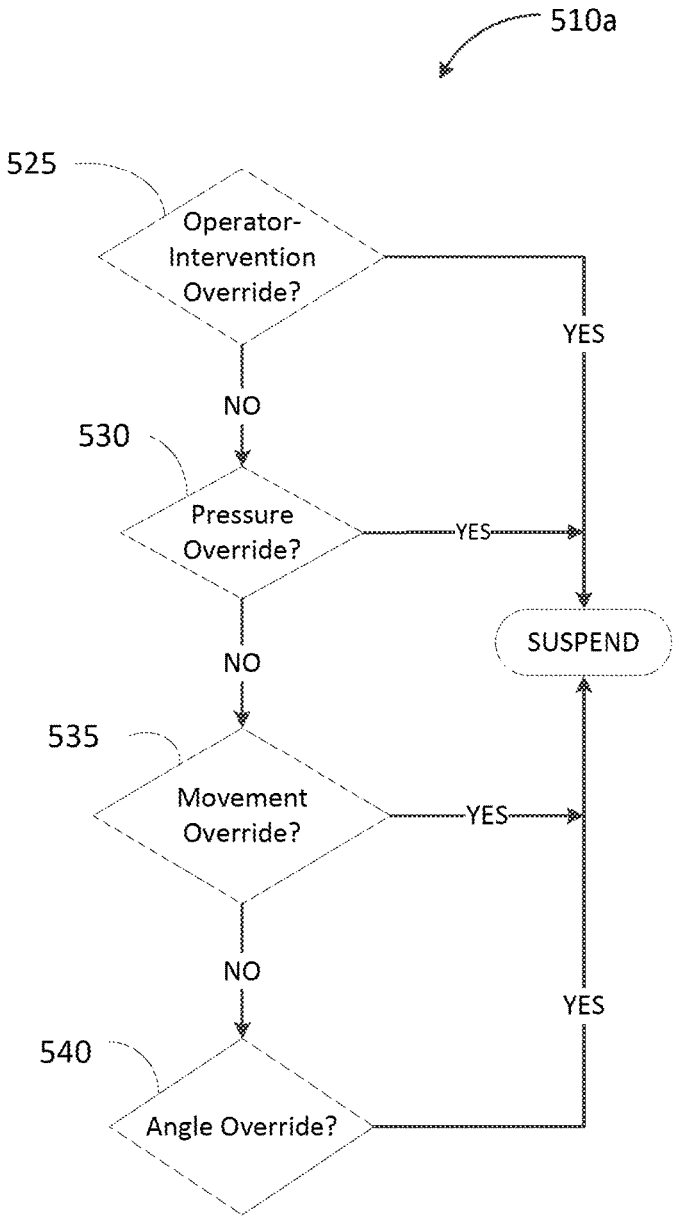
FIG. 11 is a flow chart illustrating a method of determining whether an override condition exists performed by the controller of FIG. 9 according to one embodiment.

FIG. 11 illustrates a method 510*a* performed by the controller 220 to determine whether an override condition exists according to one embodiment. In some embodiments, the controller 200 determines whether one or more different types of override conditions exists. For example, as illustrated in FIG. 11, the controller 200 may determine whether an operator-intervention override exists (at block 525). This type of override implies that the operator of the shovel 10 has selected to manually control the tilt of the bucket 34 (through manual control of the pivot actuator 36). In some embodiments, the operator may make this selection by selecting a selection mechanism, such as a button included in an operator cab, that deactivates automatic tilt control. Alternatively or in addition, an operator may set a minimum tilt reference within the system configuration parameter file that allows the operator manually control tilt. Accordingly, as illustrated in FIG. 11, the controller 200 may suspend the method 500 in response to detecting the existence of an operator-intervention override.

As illustrated in FIG. 11, the controller 200 may also determine whether a pressure override exists (at block 530). In particular, the controller 20 may read data from a pressure sensor (included in the sensors 208*a*) detecting a pressure experienced by the pivot actuator 36 and compare the detected pressure to one or more predetermined thresholds (accessed from the system configuration parameter file) to determine whether a minimum or a maximum pressure has been reached. For example, the controller 200 may check for this override to determine whether over-running loading of the shovel 10 is occurring, often associated with tilt cylinder cavitation. As illustrated in FIG. 11, the controller 200 may suspend the method 500 in response to detecting the existence of a pressure override.

The controller 200 may also determine whether a movement override exists (at block 535). As described above, in some embodiments, the system configuration parameter file may specify a minimum movement value indicating that the operator commanding movement of the bucket 34. Accordingly, the controller 200 may compare data obtained from a movement sensor, such as a velocity or motion sensor, to this minimum movement value to determine whether an operator is commanding movement of the bucket 34. As illustrated in FIG. 11, the controller 200 may suspend the method 500 in response to detecting the existence of a movement override (when the movement of the bucket 34 is below the movement minimum provided in the system configuration parameter file indicating that the bucket 34 has stopped moving and is no longer digging along the digging path).

As illustrated in FIG. 11, the controller 200 may also determine whether an angle override exists (at block 540). For example, in some embodiments, the controller 200 may be configured to suspend automatic tilt control in response to the bucket angle, the path angle, or both being outside of a digging zone (as specified in the system configuration parameter file).

It should be understood that the overrides illustrated in FIG. 11 are provided as examples and embodiments described herein may include zero or more of these example overrides in a particular implementation in various orders or priorities. Also, other types of overrides are possible. For example, in some embodiments, the controller 200 may check for the existence of a direction override, which may indicate the plurality of spaced-apart teeth 150 are not directed in a path direction. Also, the controller 200 may check for the existence of an invalid calculation override, which may indicate that a calculation performed by the controller 200 has resulted in an error (not a number, or an invalid division by zero). Similarly, in some embodiments, the controller 200 may check for the existence of an end-of-stroke override occurring for tilt-end-of-stroke, which causes the controller 200 to suspend automatic tilt control. Also, the controller 200 may be configured to check for one or more overrides associated with hydraulic leakage back to the hydraulic tank. In some embodiments, the overrides applied by the controller 200 are configurable through the system configuration parameter file.

Returning to FIG. 10, the method 500 also includes calculating, with the controller 200, a control output (at block 515). As described in more detail below, in some embodiments, the controller 200 calculates a control output by evaluating current conditions of the shovel 10 (the bucket 34) and determining whether an adjustment to the bucket 34 should be made. For example, the controller 200 may compute a current digging angle and the current limits of this angle based on the input data. It be understood that, in some embodiments, the controller 200 is configured to calculate the control output, or intermediary data used to calculate the same, in combination with checking for the existence of various overrides. For example, when the pressure override is passed (no pressure override exists), the controller 200 may be configured to determine vectors as described below. Similarly, when the movement override is passed (no movement override exists), the controller 200 may be configured to determine angles as also described below before checking for an angle override. In other embodiments, the controller 200 may be configured to calculate the control output only after the controller 200 has determined that no overrides exist. As also illustrated in FIG. 10, in some embodiments, the controller 200 may be configured to repeatedly (continuously at a predetermined frequency, in response to predetermined events or conditions, or the like) calculate the control output to provide an updated control output based on the current operation of the shovel 10.

Figure 12:
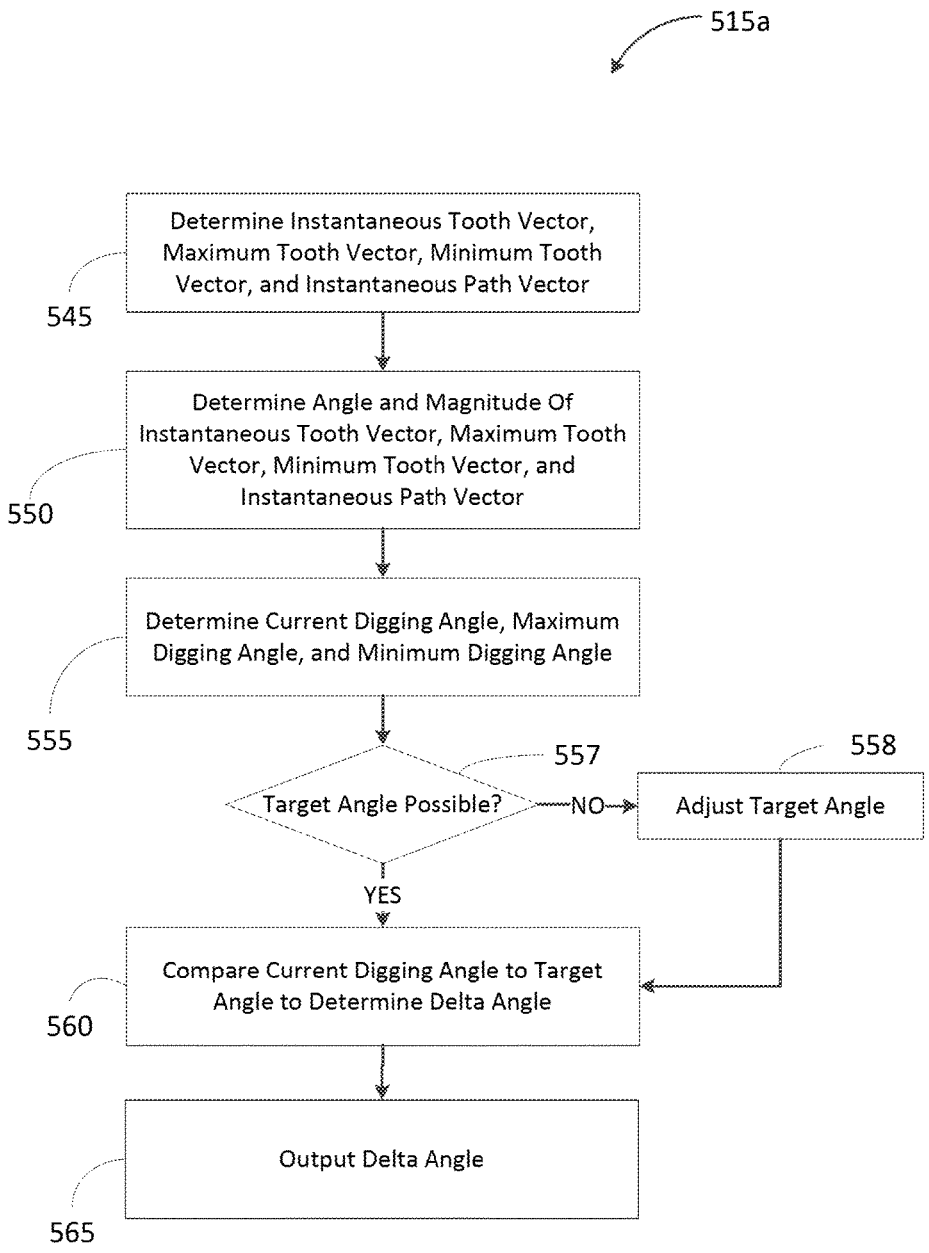
FIG. 12 is a flow chart illustrating a method of calculating a control output performed by the controller of FIG. 9 according to one embodiment.
Figure 13:
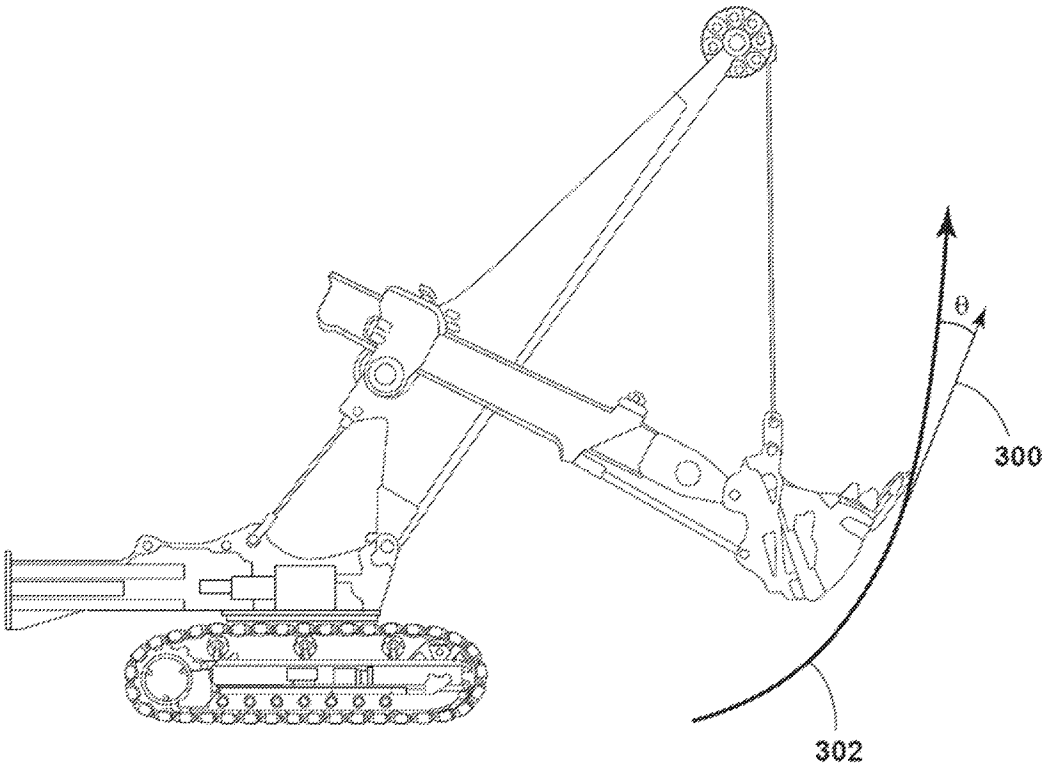
FIG. 13 illustrates a path vector and a tooth vector for a rope-shovel dig path.
Figure 14:
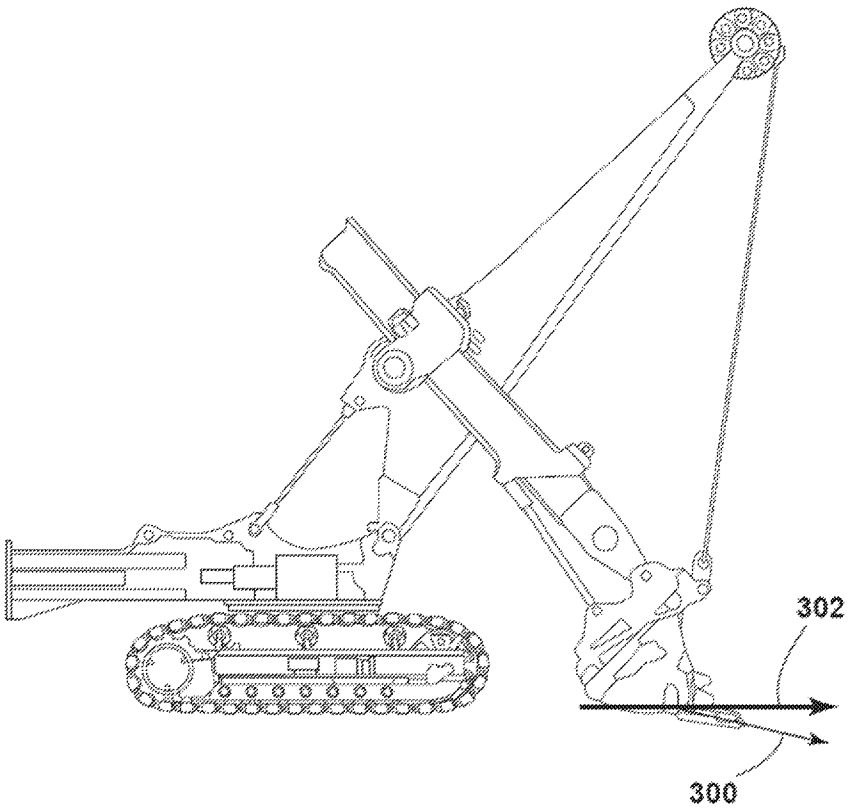
FIG. 14 illustrates a path vector and a tooth vector for a flat floor dig path.

FIG. 12 illustrates a method 515*a* performed by the controller 200 to calculate a control output according to one embodiment (at block 515, FIG. 10). As illustrated in FIG. 12, the method 515*a* includes determining, with the controller 200, one or more path vectors for the shovel 10 (at block 545). For example, the controller 200 may determine a current (instantaneous) tooth vector, a maximum tooth vector, a minimum tooth vector, and a current (instantaneous) path vector. The controller 200 may use kinematic positions of the shovel 10 to determine the vectors. FIG. 13 illustrates a current tooth vector 300 and a current path vector 302 for a rope-shovel dig path. Similarly, FIG. 14 illustrates a current tooth vector 300 and a current path vector 302 for a flat floor dig path. As illustrated in FIG. 13, the angle between the current tooth vector 300 and the current path vector 302 defines a current (instantaneous) digging angle (θ).

In some embodiments, the controller 200 may use the following equations to determine the current tooth vector and the current path vector, wherein "toothHistoryX" and "toothHistoryY" represent one or more historical positions of a tooth.

$$toothVector = \begin{bmatrix} toothVectorX \\ toothVectorY \end{bmatrix} = \begin{bmatrix} toothX \\ toothY \end{bmatrix} - \begin{bmatrix} lipX \\ lipY \end{bmatrix}$$

$$pathVector = \begin{bmatrix} pathVectorX \\ pathVectorY \end{bmatrix} = \begin{bmatrix} toothX \\ toothY \end{bmatrix} - \begin{bmatrix} toothHistoryX \\ toothHistoryY \end{bmatrix}$$

The controller 200 may determine the maximum and minimum tooth vectors using the same equation used to determine the current tooth vector but may use corresponding maximum and minimum position values.

Figure 15:
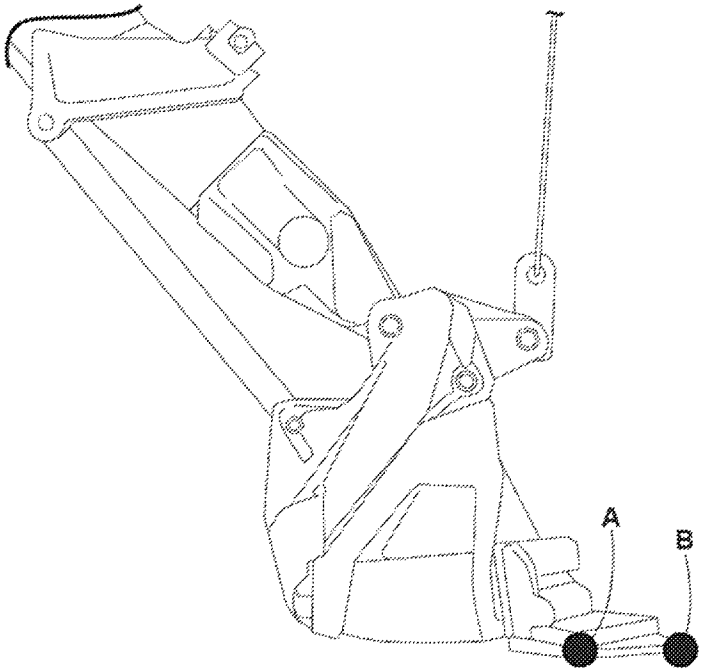
FIGS. 15 and 16 illustrate kinematic positions of the shovel for calculating path vectors.

In some embodiments, the positions of the tooth (toothX, toothY) and the lip (lipX, lipY) used in the above equations correspond to a predefined position of the lip 146 and a predefined position of the teeth 150 (or one tooth). For example, FIG. 15 illustrates a Point A representing a lip position and a Point B representing a tooth position. Accordingly, the controller 200 may use the current lip position and the current tooth position to determine the current vectors and may use a minimum and maximum tooth position to determine the minimum and maximum tooth vectors. For example, the controller 200 may determine the maximum position of the tooth when the pivot actuator 36 is fully extended and may determine the minimum position of the tooth when the pivot actuator 36 is full retracted.

Figure 16:
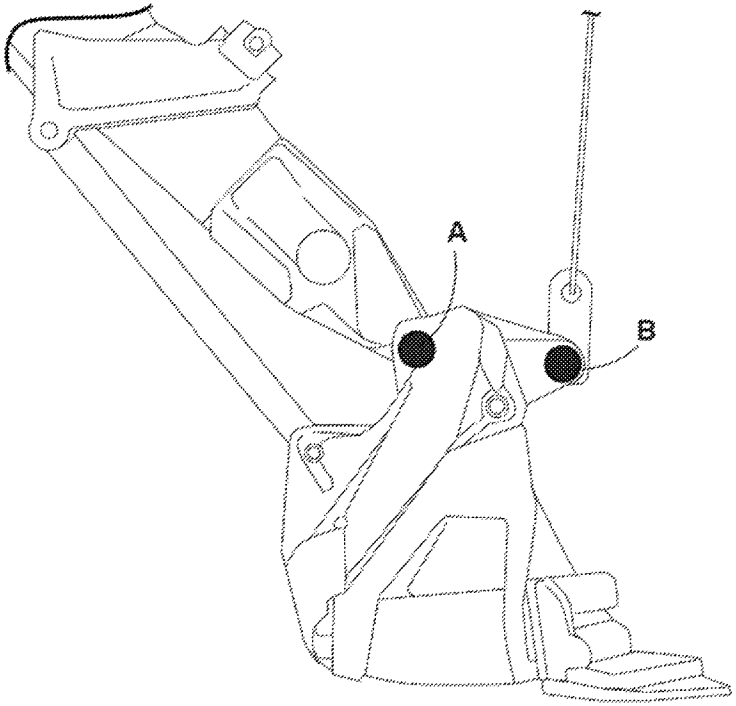

It should be understood that the controller 200 may be configured to use other points on the bucket 34 or other components of the shovel 10 to determine the vectors. For example, the controller 200 may be configured to use the bail (bail 66) (Point B) or the handle lug (wrist joint 92) (Point A) as illustrated in FIG. 16 to determine a path vector rather than a lip position. For example, due to the rope force acting on the bail and lug positions, vectors determined using the bail and log positions may different from vector determined using a lip position. Also, when the bucket 34 rotates, the bail may be affected. However, the effect of the rotation on the bail may not be as great as the effect of the rotation on the lip since the bail is closer to the center of the rotation. Therefore, there may be less change in the path angle when the controller 200 uses the bail to determine a path vector than when the controller 200 uses the lip position to determine a path vector. Similarly, since the handle lug is not a part of the bucket 34, the handle lug may experience less of an effect from rotation of the bucket 34 than the bail or the lip.

The controller 200 may also determine an angle and magnitude of each vector (at block 550, FIG. 12). For example, the controller 200 may use the following equations to determine a magnitude and an angle.

$$toothMagnitude = \sqrt{toothVectorX^2 + toothVectorY^2}$$

$$toothAngle = \cos^{-1}\left(\frac{toothVectorX}{toothMagnitude}\right) \times \frac{180}{\pi} \times \frac{toothVectorY}{[toothVectorY]}$$

The controller 200 then uses the current path vector, current tooth vector, maximum tooth vector, and minimum tooth vector to determine a current digging angle, a maximum digging angle, and a minimum digging angle (at block 555). For example, the controller 200 may use the following equation to determine a current digging angle:

$$diggingAngle = \cos^{-1}\left(\frac{toothVectorX \cdot pathVectorX + toothVectorY \cdot pathVectorY}{toothMagnitude \cdot pathMagnitude}\right) \times \frac{180}{\pi}$$

As the law of cosine only produces the angles from 0 to 180 degrees (positive angles), the orientation of the current digging angle may be checked. For example, when the path angle is greater than the tooth angle, the current digging angle is negative. Similarly, when the path angle is greater than the minimum tooth angle, the minimum digging angle is negative, and when the path angle is greater than the maximum tooth angle, the maximum digging angle is negative.

As illustrated in FIG. 12, in some embodiments, the controller 200 optionally determines whether the target angle (as specified in the system configuration parameter file as described above) is possible based on the current state of the shovel 10 (at block 557). For example, the controller 200 may compare the target angle to the determined maximum digging angle and the minimum digging angle. When the target angle falls outside of the range defined by the maximum digging angle and the minimum digging angle, the controller 200 may adjust the target angle (at block 558). For example, when the target angle is greater than the maximum digging angle, the controller 200 may set the target angle to the maximum digging angle. Similarly, when the target angle is less than the minimum digging angle, the controller 200 may set the target angle to the minimum digging angle. In other embodiments, rather than adjusting the target angle, the controller 200 may suspend the method 500 when the target angle falls outside of the range. Again, it should also be understood that determining whether the target angle is possible is optional. Therefore, when the controller 200 is not configured to perform this check, the controller 200 may not determine the maximum tooth vector and the minimum tooth vector and the associated maximum digging angle and minimum digging angle as described above.

As illustrated in FIG. 12, after any optional adjustments to the target angle, the controller 200 compares the current digging angle to the target angle to determine a delta angle (representing an error) (at block 560). For example, to determine the delta angle, the controller 200 subtracts the target angle (adjusted as necessary) from the current angle, such as by using the below equation.

$$deltaAngle = currentAngle - diggingAngle$$

The controller 200 then outputs the delta angle as a control output (at block 565).

Returning again to FIG. 10, the tilt of the bucket 34 is adjusted based on the control output (at block 520). For example, in some embodiments, the control output is provided to feedback control loop, such as a PID controller, a fuzzy neural controller, and the like, implemented by the controller 200 or a separate controller that adjusts the tilt of the bucket 34 through automatic control of the pivot actuator 36 to maintain the current digging angle as close as possible to the target angle. The gains for the implemented controller may be constant or varied, linearly or non-linearly. As noted above, gain values for the feedback control loop may be defined in the system configuration parameter file, which may vary above based on the shovel 10 and the operating environment of the shovel 10. The feedback control loop may normalize the control output (for example, from −1 to 1) before making a tilt adjustment. Depending on the kinetic model used by the controller 200, a filter may also be used to help stabilize the delta angle.

Thus, embodiments described herein provide, among other things, a controller configured to perform automatic tilt control for a shovel. In some embodiments, the controller actuates tilt motion in response to hoist and crowd commands such that a digging angle (θ) between a current tooth vector and a current path vector is limited by a predefined (and configurable) value and the physical envelop of the shovel. Accordingly, when the automatic tilt control is activated, the operator may only need to control hoist and crowd.

Various features and advantages of the embodiments described herein are set forth in the following claims.

What is claimed is:

1. A method of providing tilt control for a mining machine including a bucket, the method comprising:

determining, with an electronic processor, a current tooth vector of a tooth included on the bucket and a current path vector of the tooth;

determining, with the electronic processor, a current digging angle between the current tooth vector and the current path vector;

determining, with the electronic processor, a delta angle based on the current digging angle and a target angle; and automatically adjusting a tilt of the bucket based on the delta angle.

2. The method of claim 1, further comprising accessing the target angle from a system configuration parameter file.

3. The method of claim 1, further comprising determining whether an override condition exists and suspending automatic adjustment of the tilt of the bucket in response to the override condition existing.

4. The method of claim 3, wherein determining whether the override condition exists includes determining whether an operator is manually controlling the tilt of the bucket.

5. The method of claim 3, wherein determining whether the override condition exists includes receiving a pressure of a pivot actuator detected by a pressure sensor and comparing the pressure to a predetermined threshold.

6. The method of claim 3, wherein determining whether the override condition exists includes determining whether an operator is command movement of the bucket.

7. The method of claim 3, wherein determining whether the override condition exists includes determining whether at least one selected from a group consisting of an angle of the current tooth vector and an angle of the current path vector is outside of a digging zone.

8. The method of claim 1, wherein determining the current tooth vector includes determining the current tooth vector based on a position of the tooth and a position of a lip included on the bucket.

9. The method of claim 1, wherein determining the current path vector includes determining the current path vector based on a position of the tooth and a historical position of the tooth.

10. The method of claim 1, further comprising determining a tooth magnitude and a tooth angle based on the current tooth vector and determining a path magnitude and a path angle based on the current path vector.

11. The method of claim 10, wherein determining the current digging angle between the current tooth vector and the current path vector includes determining the current digging angle based on the tooth magnitude, the tooth angle, the path magnitude, and the path angle.

12. The method of claim 1, wherein determining the delta angle based on the current digging angle and a target angle includes determining the delta angle by subtracting the target angle from the current digging angle.

13. The method of claim 1, further comprising determining a maximum tooth vector of the tooth and a minimum tooth vector of the tooth;

determining a maximum digging angle based on the maximum tooth vector;

determining a minimum digging angle based on the minimum tooth vector; and adjusting the target angle in response to the target angle being greater than the maximum digging angle or less than the minimum digging angle.

14. The method of claim 1, wherein automatically adjusting the tilt of the bucket based on the delta angle includes providing the delta angle to a feedback control loop, the feedback control loop automatically adjusting the tilt of the bucket via a pivot actuator.

15. An industrial machine comprising:

a bucket having a tooth; and a controller configured to determine a current tooth vector of the tooth and a current path vector of the tooth, determine a maximum angle of the tooth and a minimum angle of the tooth, access a target angle, adjust the target angle in response to the target angle being greater than the maximum angle of the tooth or less than the minimum angle of the tooth, determine a current digging angle between the current tooth vector and the current path vector, determine a delta angle based on the current digging angle and the target angle, and automatically adjust a tilt of the bucket based on the delta angle via a pivot actuator.

16. The industrial machine of claim 15, wherein the controller is configured to automatically adjust the tilt of the bucket based on the delta angle by providing the delta angle to a feedback control loop.

17. The industrial machine of claim 15, wherein the controller is further configured to determine whether an override condition exists and suspend automatic adjustment of the tilt of the bucket in response to the override condition existing.

18. Non-transitory, computer-readable medium storing instructions that, when executed by an electronic processor, perform a set of functions, the set of functions comprising:

determining a current tooth vector of a tooth included on a bucket of an industrial machine and a current path vector of the tooth;

determining a maximum angle of the tooth and a minimum angle of the tooth;

accessing a target angle;

adjusting the target angle in response to the target angle being greater than the maximum angle of the tooth or less than the minimum angle of the tooth;

determining a current digging angle between the current tooth vector and the current path vector;

determining a delta angle based on the current digging angle and the target angle; and automatically adjusting a tilt of the bucket using a feedback control loop based on the delta angle via a pivot actuator.

19. The non-transitory, computer-readable medium of claim 18, wherein determining the current tooth vector of the tooth includes determining the current tooth vector based on a position of the tooth and a position of a lip included on the bucket.

20. The non-transitory, computer-readable medium of claim 18, wherein determining the current path vector of the tooth includes determining the current path vector based on a position of the tooth and a historical position of the tooth.

* * * * *